US010174648B2

(12) United States Patent
Schmitt et al.

(10) Patent No.: US 10,174,648 B2
(45) Date of Patent: Jan. 8, 2019

(54) SYSTEMS AND METHODS FOR CAM PHASING CONTROL

(71) Applicant: HUSCO AUTOMOTIVE HOLDINGS LLC, Waukesha, WI (US)

(72) Inventors: Austin Schmitt, Hartland, WI (US); Allen Tewes, Spirit Lake, IA (US); Brian Heidemann, Lake Mills, WI (US); Michael Kujak, Delafield, WI (US)

(73) Assignee: HUSCO Automotive Holdings LLC, Waukesha, WI (US)

( * ) Notice: Subject to any disclaimer, the term of this patent is extended or adjusted under 35 U.S.C. 154(b) by 0 days.

(21) Appl. No.: 15/682,998

(22) Filed: Aug. 22, 2017

(65) Prior Publication Data

US 2018/0058273 A1 Mar. 1, 2018

Related U.S. Application Data

(60) Provisional application No. 62/378,314, filed on Aug. 23, 2016.

(51) Int. Cl.
*F01L 1/34* (2006.01)
*F01L 1/344* (2006.01)

(52) U.S. Cl.
CPC ..... *F01L 1/3442* (2013.01); *F01L 1/344* (2013.01); *F01L 2001/3443* (2013.01); *F01L 2001/3444* (2013.01); *F01L 2001/34489* (2013.01); *F01L 2001/34496* (2013.01)

(58) Field of Classification Search
CPC . F01L 1/3442; F01L 1/344; F01L 2001/3444; F01L 2001/3443; F01L 2001/34489; F01L 2001/34496
See application file for complete search history.

(56) References Cited

U.S. PATENT DOCUMENTS

| | | | | |
|---|---|---|---|---|
| 6,763,791 | B2 * | 7/2004 | Gardner | F01L 1/34 123/90.15 |
| 6,997,150 | B2 | 2/2006 | Simpson | |
| 9,115,610 | B2 | 8/2015 | Tewes et al. | |
| 2015/0330268 | A1 | 11/2015 | Tewes et al. | |

* cited by examiner

*Primary Examiner* — Zelalem Eshete
(74) *Attorney, Agent, or Firm* — Quarles & Brady LLP

(57) ABSTRACT

Systems and methods for a cam phasing control system are provided. In particular, systems and methods are provided for a cam phasing control system that can be configured to control a first cam phase actuator and a second cam phase actuator and selectively switch the operation thereof between a regenerative mode and an oil pressure actuation mode.

26 Claims, 17 Drawing Sheets

SYSTEMS AND METHODS FOR CAM PHASING CONTROL

CROSS-REFERENCES TO RELATED APPLICATIONS

The present application is based on, claims priority to, and incorporates herein by reference in its entirety, U.S. Provisional Patent Application No. 62/378,314, filed on Aug. 23, 2016, and entitled "Systems and Methods for a Cam Phasing Control System."

STATEMENT REGARDING FEDERALLY SPONSORED RESEARCH

Not Applicable.

BACKGROUND

The present disclosure relates generally to variable valve timing for internal combustion engines and, more specifically, to systems and methods for cam phasing control.

Internal combustion engines include a plurality of cylinders with pistons received therein that are connected to drive a crank shaft. Each cylinder has two or more valves that control the flow of air into the cylinder and the flow of exhaust gases out of the cylinder. The intake and exhaust valves can be actuated at different times during the engine cycle (e.g., during the intake and exhaust strokes, respectively) by a cam shaft, which is mechanically connected to be rotated by the crank shaft.

It has been recognized that optimum engine performance (e.g., engine efficiency and emissions) can be obtained if the valve timing varies, for example, as a function of engine speed, engine load, atmospheric pressure, and other factors. During engine operation, a cam phase actuator (cam phaser) can be used to alter a rotational relationship of the cam shaft relative to the crank shaft (i.e., cam phasing), which, in turn, alters when the intake and/or exhaust valves open and close.

Currently, cam phasers can be hydraulically actuated, electronically actuated, or mechanically actuated. For hydraulically actuated cam phasers, there are two operational modes for cam phasing, namely, cam torque actuation mode and oil pressure actuation mode. Cam torque actuation mode utilizes torque pulses imposed on the cam shaft to rotate the cam phaser. Oil pressure actuated mode uses oil pressure from the engine's pump to rotate the cam phaser.

BRIEF SUMMARY

The present disclosure provides systems and methods for cam phasing control. In particular, a cam phasing control system is disclosed that can be configured to control a first cam phase actuator and a second cam phase actuator, and selectively switch the operation thereof between a regenerative mode and an oil pressure actuation mode.

In one aspect, the present disclosure provides a cam phasing control system configured to be coupled to an internal combustion engine for controlling a flow of fluid to and from a cam phase actuator. The internal combustion engine includes a pump, a cam shaft, and a crank shaft. The cam phase actuator includes a first actuator port and a second actuator port. The cam phasing control system includes a manifold having a supply chamber, a first port chamber, a second port chamber, a regen chamber, and an outlet port. The cam phasing control system further includes at least one control valve having a solenoid and a spool moveable between a plurality of positions in response to activation of the solenoid. The spool is slidably received within the manifold. The cam phasing control system further includes at least one regen valve arranged within the manifold and in fluid communication with the regen chamber. The at least one regen valve is moveable between a first regen valve position where fluid communication is inhibited from the regen chamber through the outlet port and a second regen valve position where fluid communication is provided from the regen chamber through the outlet port. The at least one regen valve is moveable between the first position and the second position in response to a pressure in the supply chamber. When the at least one regen valve is in the first regen valve position, the cam phase actuator is operable in a regenerative mode, and when the at least one regen valve is in the second poppet position, the cam phase actuator is operable in an oil pressure actuated mode.

In another aspect, the present disclosure provides a filter plate for a cam phasing control system. The cam phasing control system includes a supply port, one or more workports, and one or more regen ports. The filter plate includes one or more check valves. One of the one or more check valves is arranged to enable fluid to flow through the supply port only in a desired direction. The filter plate further includes one or more filters. One of the one or more filters is arranged to filter fluid flowing from the supply port.

The foregoing and other aspects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims and herein for interpreting the scope of the invention.

BRIEF DESCRIPTION OF DRAWINGS

The invention will be better understood and features, aspects and advantages other than those set forth above will become apparent when consideration is given to the following detailed description thereof. Such detailed description makes reference to the following drawings.

DETAILED DESCRIPTION

Figure 1:
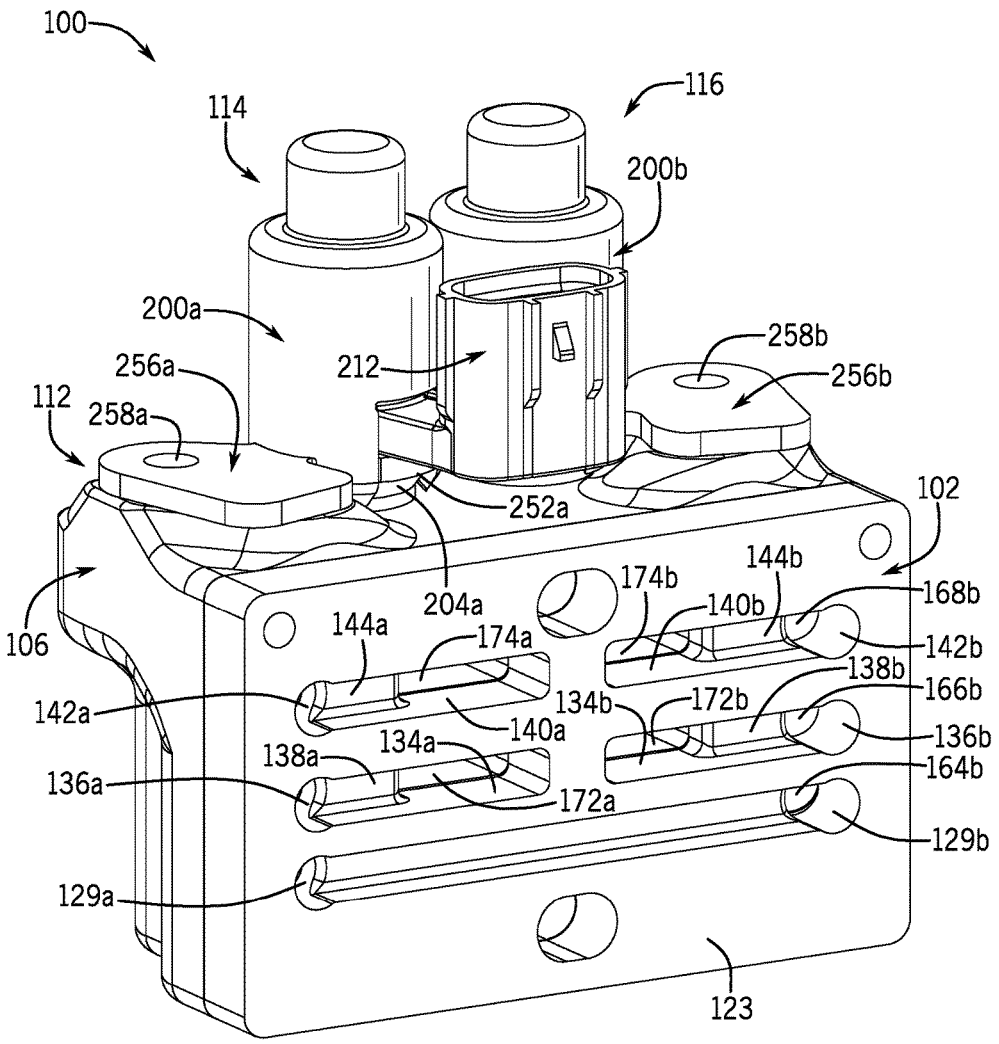
FIG. 1 is a top, front, left isometric view of a cam phasing control system according to one aspect of the present disclosure.
Figure 2:
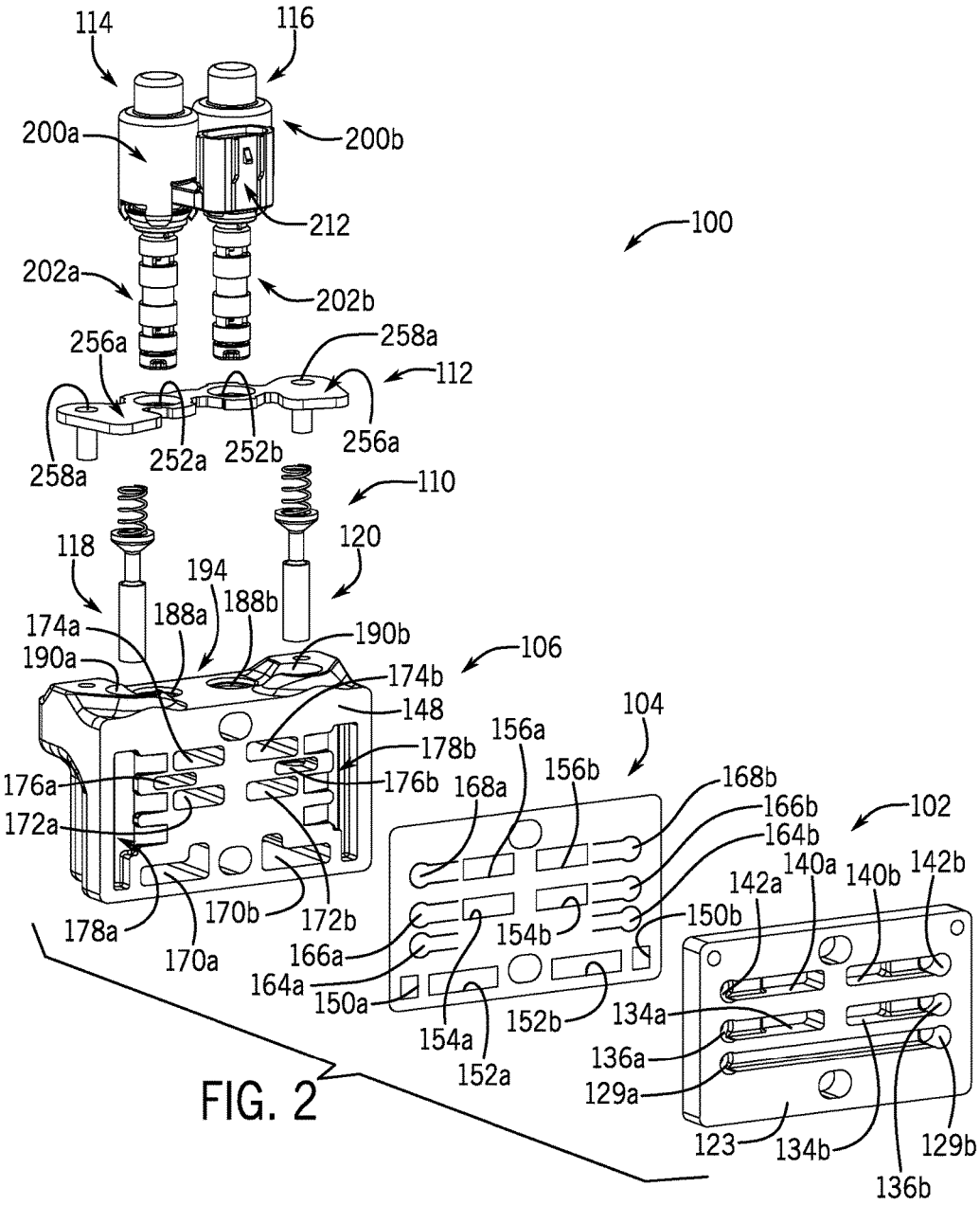
FIG. 2 is an exploded top, front, left isometric view of the cam phasing control system of FIG. 1.
Figure 3:
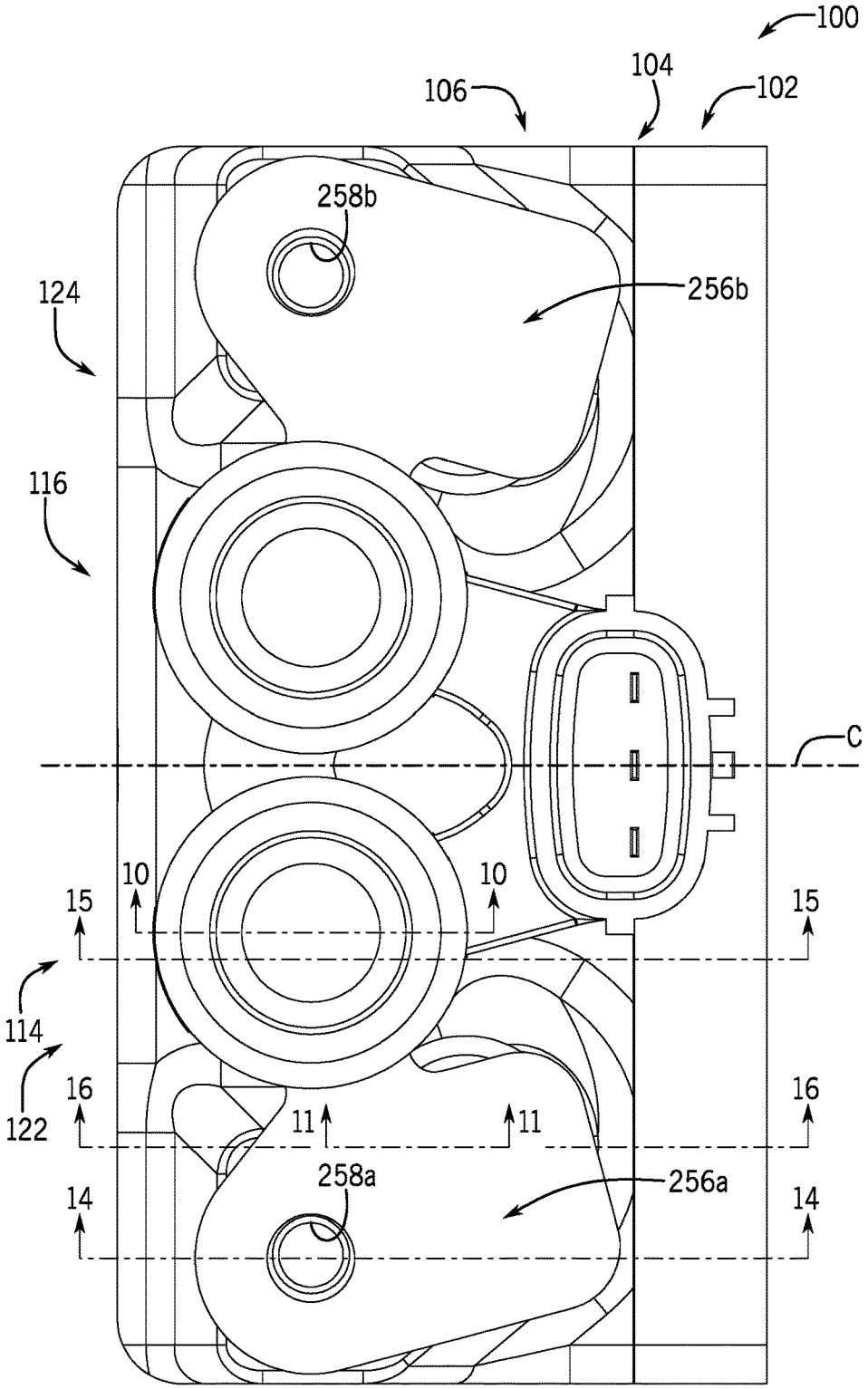
FIG. 3 is a top view of the cam phasing control system of FIG. 1.
Figure 4:
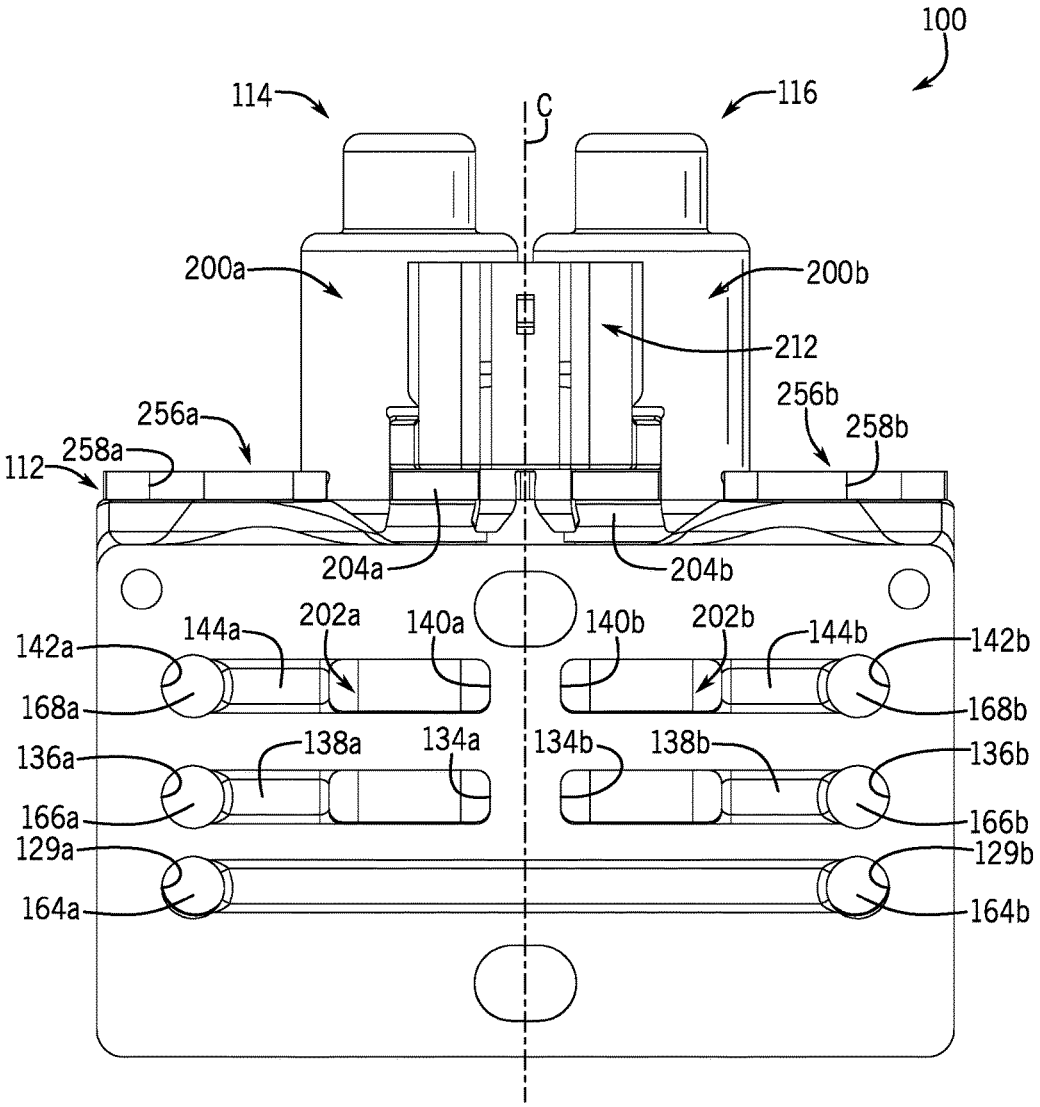
FIG. 4 is a front view of the cam phasing control system of FIG. 1.

FIGS. 1-4 illustrate a cam phasing control system 100 according to one non-limiting example of the present disclosure. As shown in FIGS. 1-4, the cam phasing control system 100 can include an end plate 102, a filter plate 104, a manifold 106, one or more control valves 108, one or more poppets 110 and a mounting bracket plate 112. In the illustrated cam phasing control system 100, the one or more control valves 108 can include a first control valve 114 and a second control valve 116, and the one or more poppets 110 can include a first regen valve 118 and a second regen valve 120. The cam phasing control system 100 can be symmetrical about a center plane C (FIGS. 3 and 4). Each of the end plate 102, the filter plate 104, the manifold 106, and the mounting bracket plate 112 can be symmetrical about the center plane C. The center plane C can divide the cam phasing control system 100 into a first side 122 and a second side 124. The first side 122 can include the first control valve 114 and the first regen valve 118, and can be configured to control a first cam phase actuator (not shown). The second side 124 can include the second control valve 116 and the second regen valve 120, and can be configured to control a second cam phase actuator (not shown). Thus, the cam phasing control system 100 provides a single package that enables the control of cam phasing for two cam shafts on an internal combustion engine.

The components and design of the first side 122 of the cam phasing control system 100 can be similar to the components and design of the second side 124 of the cam phasing control system 100. As such, the following description of the components, design, and operation of the first side 122 of the cam phasing control system 100 also applies to the components, design, and operation of the second side 124 of the cam phasing control system 100. Similar features are identified using like reference numerals with the features on the first side 122 denoted using the suffix "a" and the features on the second side 124 denoted using the suffix "b." That is, for each feature described using a reference numeral with the suffix "a," the cam phasing control system 100 includes a corresponding symmetric feature arranged on the second side 124 labeled using the suffix "b." It should also be appreciated that the first control valve 114 and the second control valve 116 can be similar in design and functionality and, thus, the following description of the first control valve 114 also applies to the second control valve 116. Additionally, the first regen valve 118 and the second regen valve 120 can be similar in design and functionality and, thus, the following description of the first regen valve 118 also applies to the second regen valve 120.

Figure 5:
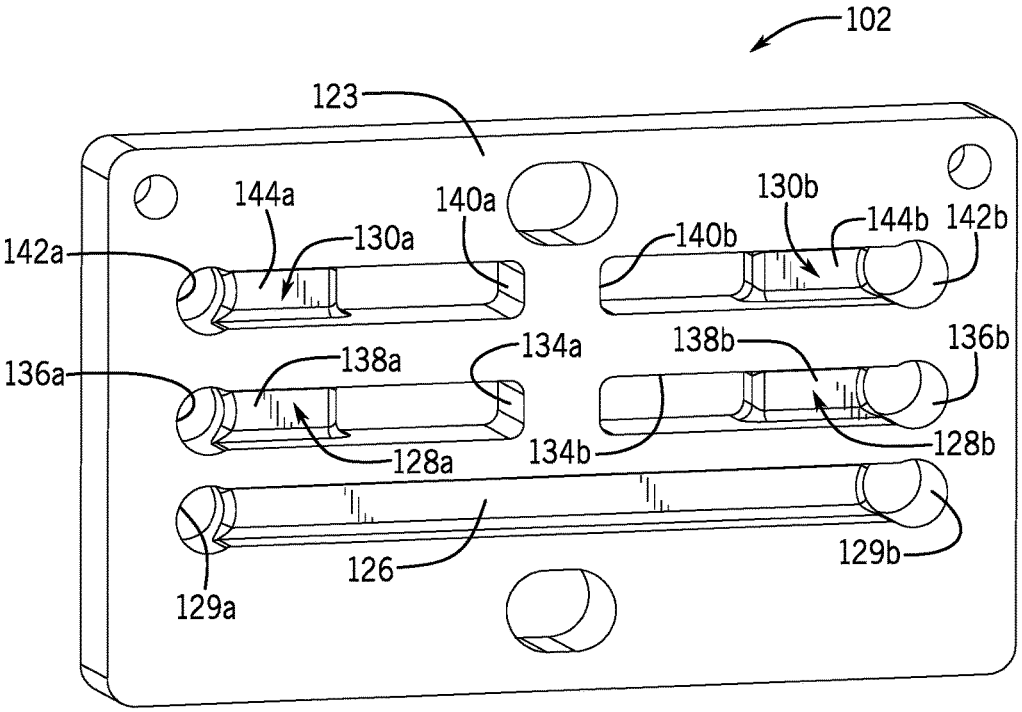
FIG. 5 is a top, front, left isometric view of an end plate of the cam phasing control system of FIG. 1.
Figure 6:
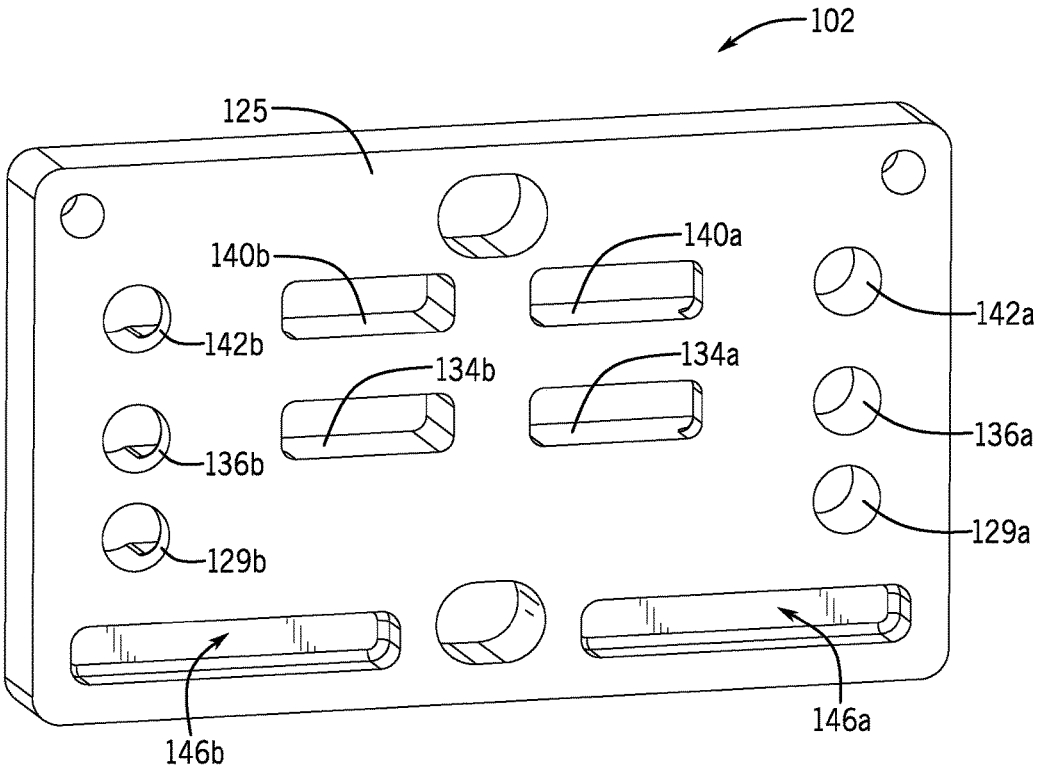
FIG. 6 is a top, back, right isometric view of an end plate of the cam phasing control system of FIG. 1.

Turning to FIGS. 5 and 6, the end plate 102 can include a front surface 123 and a back surface 125. The front surface 123 of the end plate 102 can include a supply recess wall 126, a first port recess **128*a*, and a second port recess 130*a*. The supply recess wall 126 can extend partially into the end plate 102 (i.e., recessed into the front surface 123 to a location between the front surface 123 and the back surface 125) and a supply port 129*a* can be arranged at a distal end thereof. The supply port 129*a* can extend completely through the end plate 102 to enable fluid flow therethrough. The first port recess 128*a* can include a first workport 134*a*, a first regen port 136*a*, and a first recess wall 138*a* arranged between the first workport 134*a* and the first regen port 136*a*. The first workport 134*a* and the first regen port 136*a* can be arranged at opposing ends of the first port recess 128*a*, and both can extend completely through the end plate 102 to enable fluid flow therethrough. The first recess wall 138*a* can extend partially into the end plate 102 (i.e., recessed into the front surface 123 to a location between the front surface 123 and the back surface 125) to enable fluid communication between the first workport 134*a* and the first regen port 136*a*. The second port recess 130*a* can include a second workport 140*a*, a second regen port 142*a*, and a second recess wall 144*a* arranged between the second workport 140*a* and the second regen port 142*a*. The second workport 140*a* and the second regen port 142*a* can be arranged at opposing ends of the second port recess 130*a*, and both can extend completely through the end plate 102 to enable fluid flow therethrough. The second recess wall 144*a* can extend partially into the end plate 102 (i.e., recessed into the front surface 123 to a location between the front surface 123 and the back surface 125) to enable fluid communication between the second workport 140*a* and the second regen port 142*a*. The back surface 125 of the end plate 102 can include a supply passageway 146*a*, which defines a recess that extends partially into the end plate 102 (i.e., recessed into the back surface 125 to a location between the front surface 123 and the back surface 125**).

Figure 7:
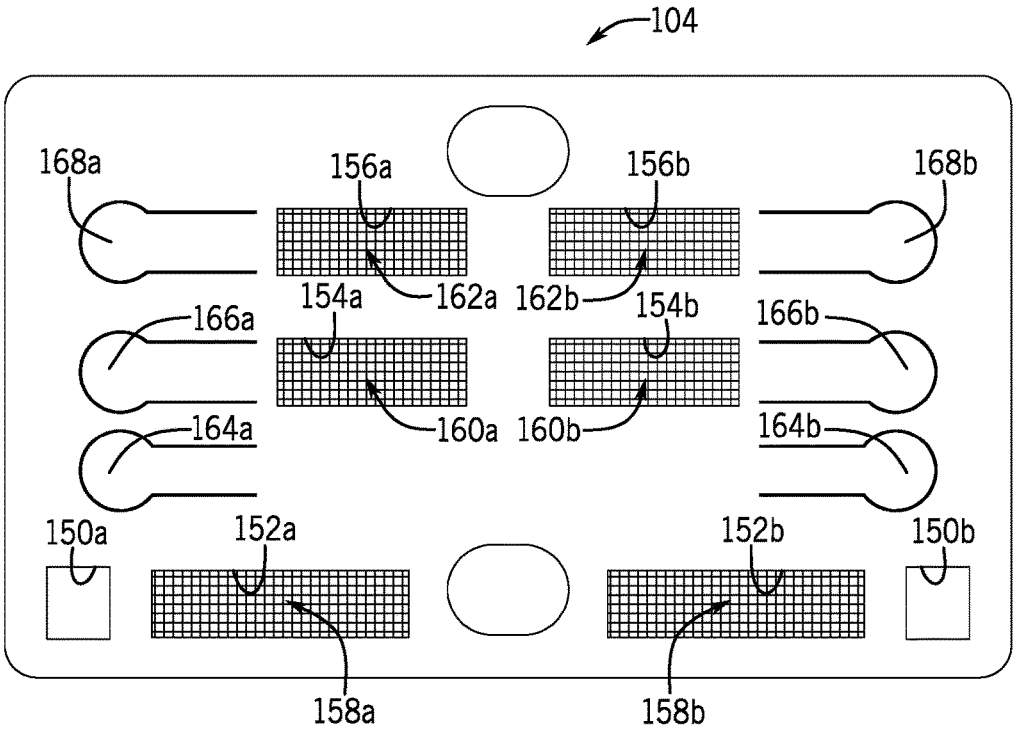
FIG. 7 is a front view of a filter plate of the cam phasing control system of FIG. 1.

When assembled, the filter plate 104 can be coupled between the end plate 102 and a front surface 148 of the manifold 106. The filter plate 104 can define a flat, thin plate that includes a plurality of check valve and filter features. In some non-limiting examples, the filter plate 104 can be fabricated from a metal material (e.g., stainless steel) or can be fabricated from a plastic material (e.g., nylon). As shown in FIG. 7, the filter plate 104 can include a first supply cutout **150*a*, a second supply cutout 152*a*, a first port cutout 154*a*, and a second port cutout 156*a*. Each of the second supply cutout 152*a*, the first port cutout 154*a*, and the second port cutout 156*a* can include a filter 158*a*, 160*a*, and 162*a*, respectively, formed therein. The illustrated filters 158*a*, 160*a*, and 162*a*, can be in the form of mesh filters configured to filter contaminants and/or particulates in fluid flowing through the respective one of the second supply cutout 152*a*, the first port cutout 154*a*, and the second port cutout 156*a***.

In some non-limiting examples, the filters 158*a*, 160*a*, and 162*a* may be in the form of a metal plate (e.g., stainless steel) having a plurality of small holes arranged thereon.

The filter plate 104 can include a supply check valve 164*a*, a first regen port check valve 166*a*, and a second regen port check valve 168*a*. Each of the illustrated supply check valve 164*a*, the first regen port check valve 166*a*, and the second regen port check valve 168*a* can be in the form of a reed valve hingidly attached to the filter plate 104. When the filter plate 104 is assembled between the front surface 148 of the manifold 106 and the end plate 102, the supply check valve 164*a* can be in engagement with the back surface 125. This can prevent the supply check valve 164*a* from hinging open in a direction toward the end plate 102, and only allow the supply check valve 164*a* to hinge open in a direction toward the manifold 106. In this way, the supply check valve 164*a* can allow fluid to flow only in a direction from the supply port 129*a* into the manifold 106. Similarly, the first regen port check valve 166*a* and the second regen port check valve 168*a* can engage the back surface 125 of the end plate 102, when assembled. Accordingly, the first regen port check valve 166*a* can allow fluid to flow only in a direction from the first regen port 136*a* into the manifold 106, and the second regen port check valve 168*a* can allow fluid to flow only in a direction from the second regen port 142*a* into the manifold 106.

Figure 8:
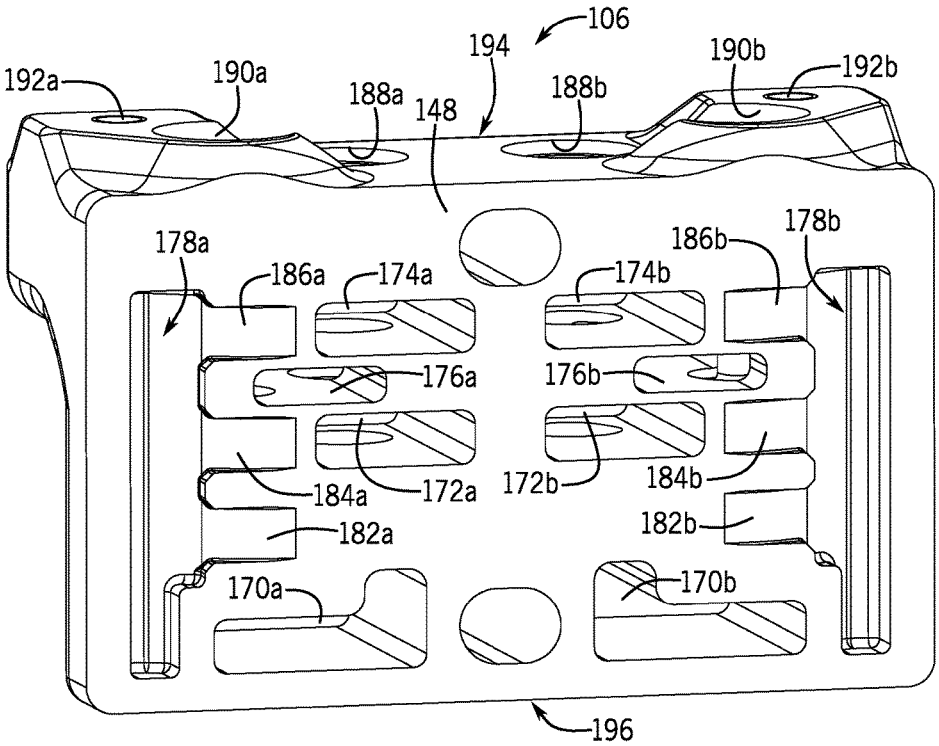
FIG. 8 is a top, front, left isometric view of a manifold of the cam phasing control system of FIG. 1.
Figure 9:
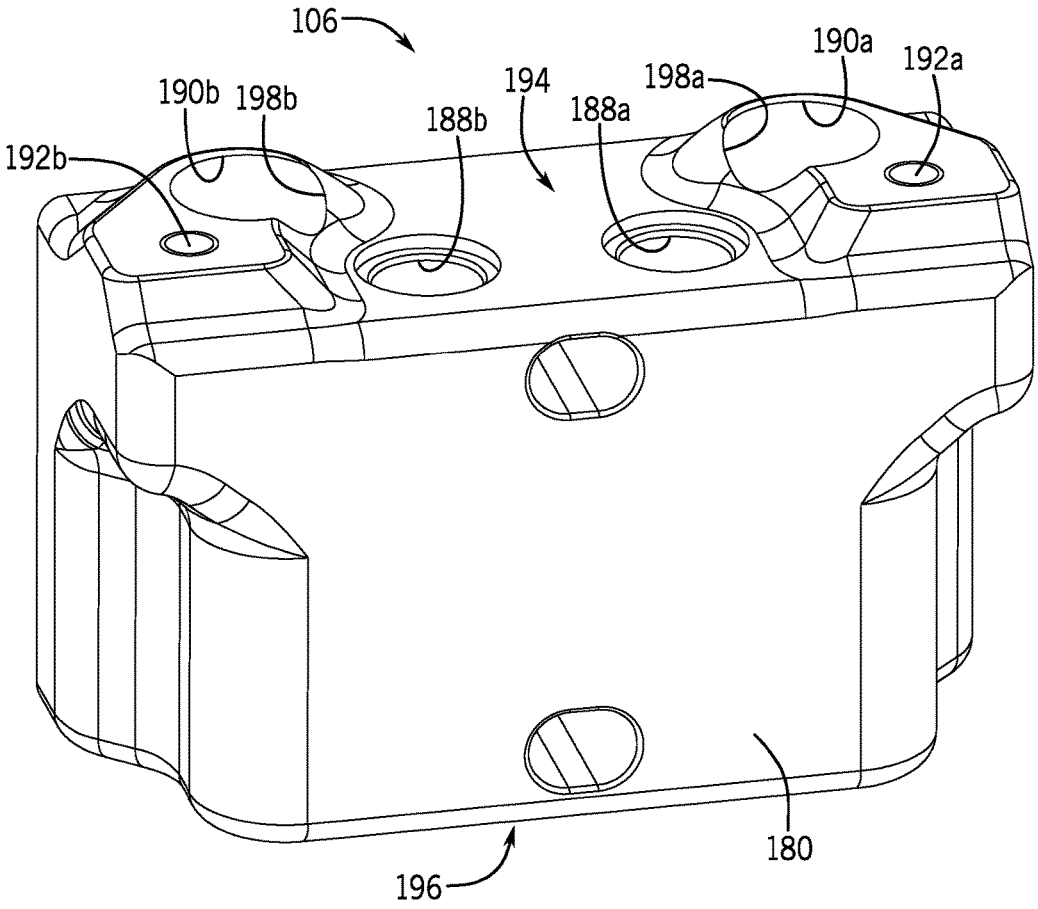
FIG. 9 is a top, back, right isometric view of a manifold of the cam phasing control system of FIG. 1.

Turing to FIGS. 8 and 9, the manifold 106 can include a supply chamber 170*a*, a first port chamber 172*a*, a second port chamber 174*a*, a regen chamber 176*a*, and a pre-supply chamber 178*a*. The supply chamber 170*a* can define a recessed chamber in the manifold 106 extending from the front surface 148 to a position between the front surface 148 and a back surface 180 of the manifold 106. The first port chamber 172*a*, the second port chamber 174*a*, and the regen chamber 176*a* each can define a recessed chamber in the manifold 106 extending from the front surface 148 to a position between the front surface 148 and the back surface 180 of the manifold 106. The pre-supply chamber 178*a* can include a supply portion 182*a*, a first port portion 184*a*, and a second port portion 186*a*. The supply portion 182*a* can be configured to receive fluid flowing from the supply port 129*a* through the supply check valve 164*a*. The first port portion 184*a* can be configured to receive fluid flowing from the first regen port 136*a* through the first regen port check valve 166*a*. The second port portion 186*a* can be configured to receive fluid flowing from the second regen port 142*a* through the second regen port check valve 168*a*. Thus, fluid flowing through the supply check valve 164*a*, the first regen port check valve 166*a*, and the second regen port check valve 168*a* can flow into the pre-supply chamber 178*a*. As will be described, the pre-supply chamber 178*a* can be in fluid communication with the supply chamber 170*a* via the supply passageway 146*a* in the end plate 102.

The manifold 106 can include a control valve mounting bore 188*a*, a regen valve mounting bore 190*a*, and a bracket mounting aperture 192*a*. The control valve mounting bore 188*a* can extend into the manifold 106 from a top side 194 to a location between the top side 194 and a bottom side 196. The control valve mounting bore 188*a* can extend through each of the first port chamber 172*a* and the second port chamber 174*a*. The control valve mounting bore 188*a* can also extend partially through the regen chamber 176*a* and into the supply chamber 170*a*. The regen valve mounting bore 190*a* can extend at least partially through the regen chamber 176*a* and into the supply chamber 170*a*. The regen valve mounting bore 190*a* can include an outlet port 198*a*. The illustrated outlet port 198*a* can define a generally U-shaped cutout in the regen valve mounting bore 190*a* adjacent to the top side 194 of the manifold. The generally U-shaped cutout defined by the outlet port 198*a* can enable fluid to flow through the outlet port 198*a* when the mounting bracket plate 112 is fastened on top of the regen valve mounting bore 190*a*, when the cam phasing control system is assembled. It should be appreciated that the shape (i.e., the generally U-shaped cutout) defined by the outlet port 198*a* is not meant to be limiting in any way and, in other non-limiting examples, the outlet port 198*a* may be designed to define any shape or profile, as desired.

Figure 10:
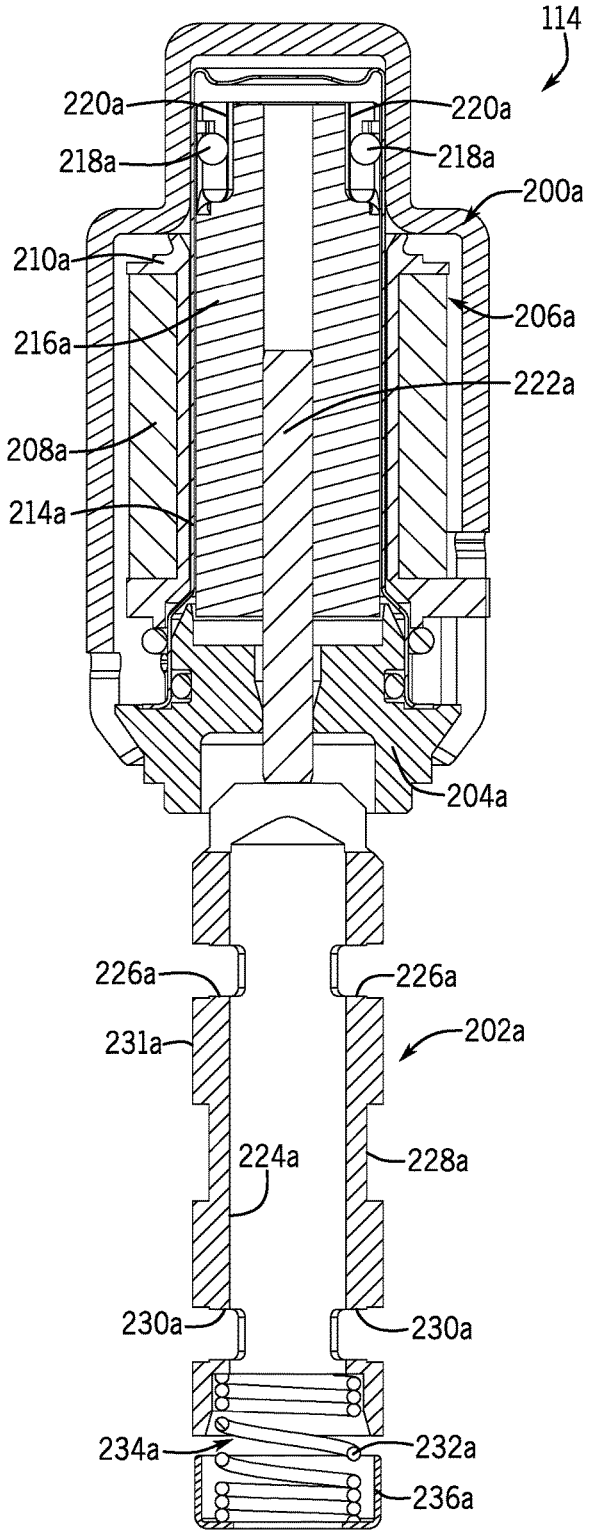
FIG. 10 is a cross-sectional view of a first control valve of the cam phasing control system of FIG. 1 taken along line 10-10 of FIG. 3.

Turning to FIG. 10, the first control valve 114 can include a housing 200*a* and a spool 202*a*. The housing 200*a* can be coupled to a pole piece 204*a*, which can be partially received within the housing 200*a*. A solenoid 206*a* can be arranged within the housing 200*a*, and can include a wire coil 208*a* wrapped around a bobbin 210*a*. One or more terminals (not shown) may be configured to provide electrical communication between the wire coil 208*a* and a connector 212. An armature tube 214*a* can be arranged within the housing 200*a*. The armature tube 214*a* can be concentrically arranged inside of the wire coil 208*a*, and an armature 216*a* can be slidably received within the armature tube 214*a*. The illustrated armature 216*a* can be slidably received within the armature tube 214*a* via a plurality of ball bearings 218*a* each received within a corresponding bearing retaining slot 220*a* formed on the armature 216*a*. The armature 216*a* can be coupled to the spool 202*a* by a pin 222*a*. In operation, the wire coil 208*a* can be selectively energized and produce a magnetic force, which, in turn, actuates the armature 216*a* and thereby the spool 202*a* in a desired direction.

The spool 202*a* can be dimensioned to be received within the control valve mounting bore 188*a*. The spool 202*a* can define a generally annular shape with an internal bore 224*a* extending longitudinally therethrough such that fluid can flow into and through the internal bore 224*a* of the spool 202*a*. The spool 202*a* can include a first spool cutout 226*a*, a spool notch 228*a*, and a second spool cutout 230*a*. The first spool cutout 226*a* and the second spool cutout 230*a* can define annular radial recesses in the spool 202*a*. The first spool cutout 226*a* can be longitudinally, or axially, separated from the second spool cutout 230*a* with the spool notch 228*a* arranged therebetween. In operation, as will be described, the first spool cutout 226*a* can enable fluid to flow from the internal bore 224*a* into the second port chamber 174*a*, and the second spool cutout 230*a* can enable fluid to flow from the internal bore 224*a* into the first port chamber 172*a*. The spool notch 228*a* can define a radial recess on an outer surface 231*a* of the spool 202*a*. The spool 202*a* can be biased upwards in a direction toward the housing 200*a* by a spool spring 232*a*. The spool spring 232*a* can be arranged between a distal end 234*a* of the internal bore 224*a* and a spring retainer 236*a*.

Figure 11:
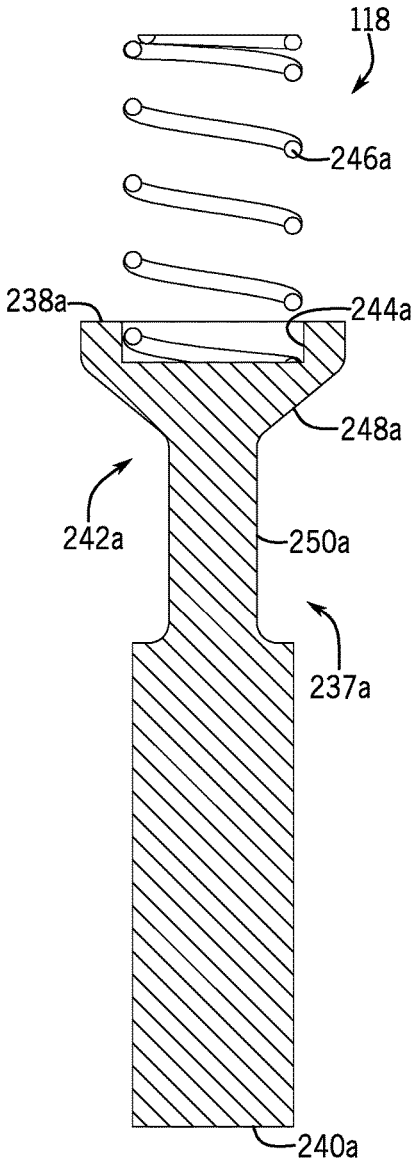
FIG. 11 is a cross-sectional view of a first regen valve in the form of a first poppet and a biasing element of the cam phasing control system of FIG. 1 taken along line 11-11 of FIG. 3.
Figure 13:
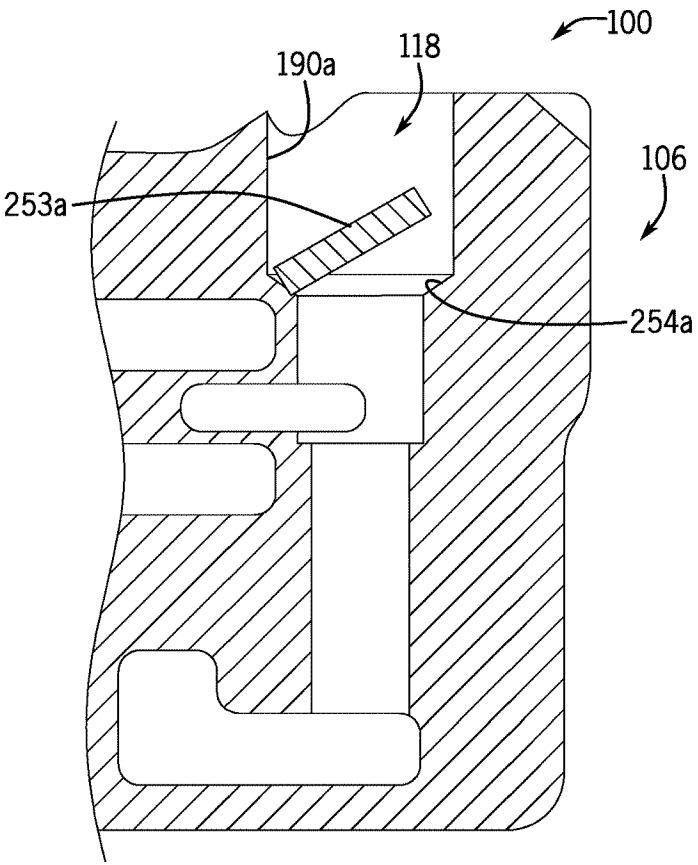
FIG. 13 is a schematic illustration of a first regen valve in the form of a swing of the cam phasing system of FIG. 1 according to another aspect of the present disclosure
Figure 12:
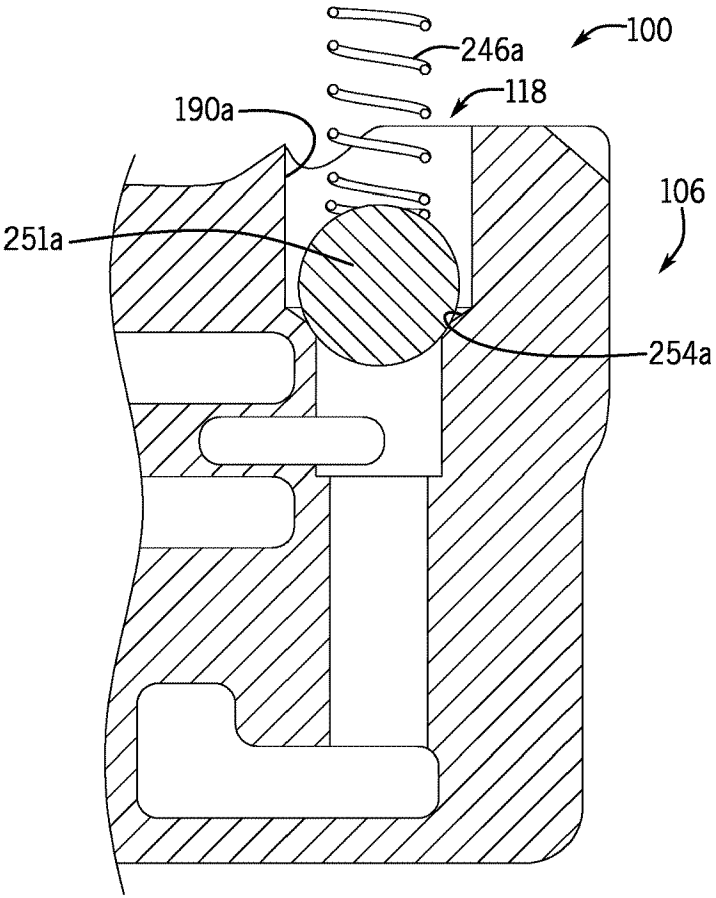
FIG. 12 is a schematic illustration of a first regen valve in the form of a ball and a biasing element of the cam phasing control system of FIG. 1 according to one aspect of the present disclosure.
Figure 14:
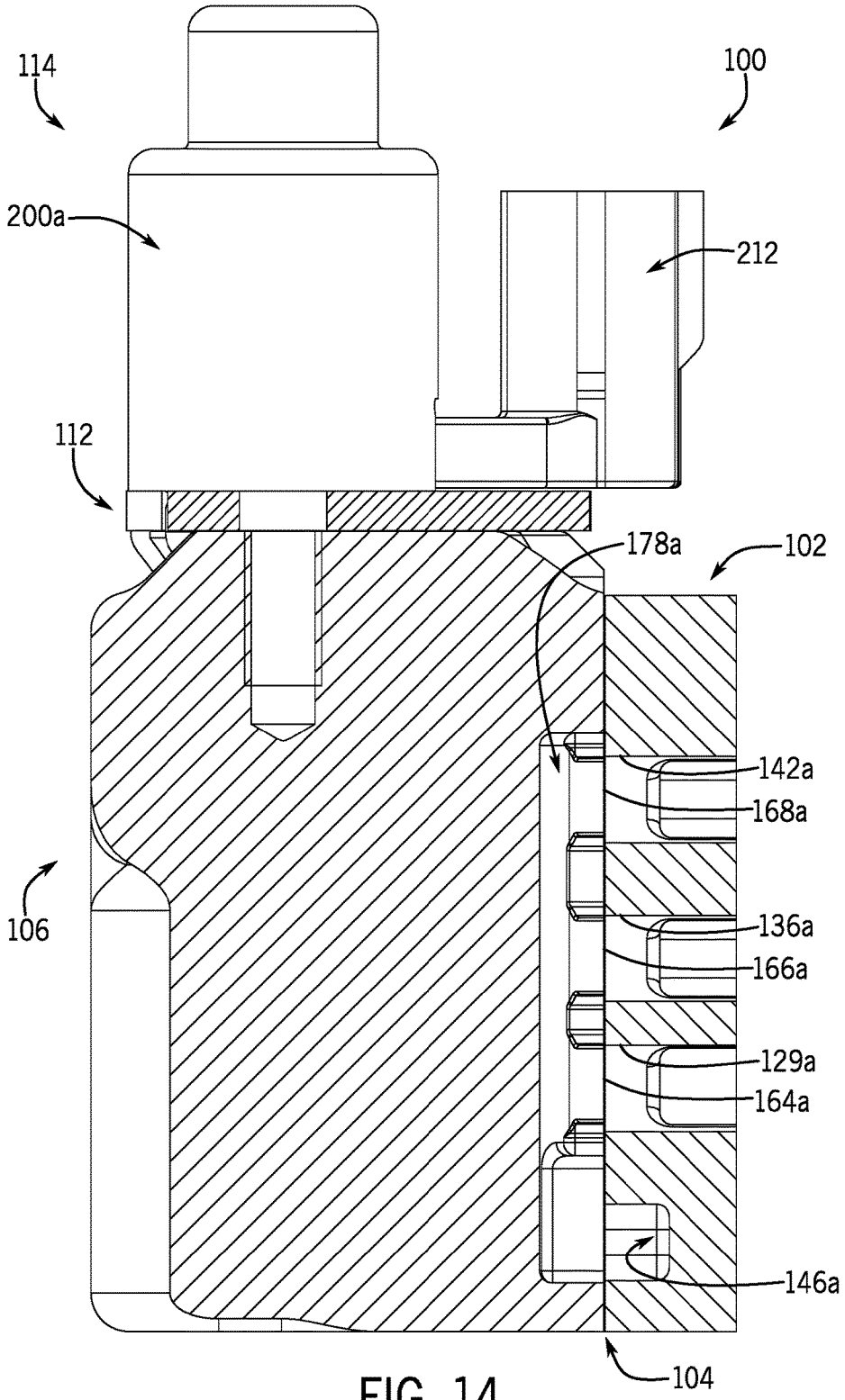
FIG. 14 is a cross-sectional view of the cam phasing control system of FIG. 1 taken along line 14-14 of FIG. 3.
Figure 15:
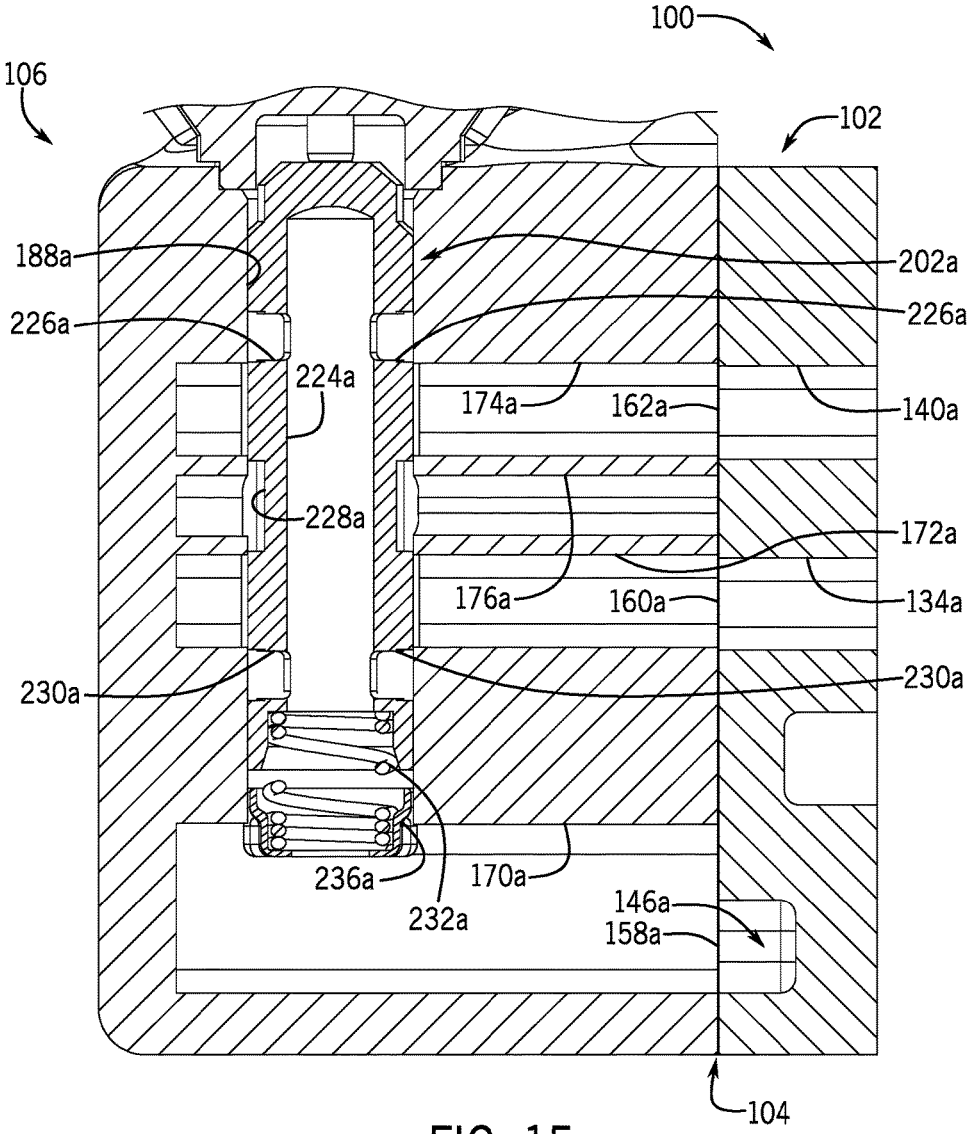
FIG. 15 is a cross-sectional view of the cam phasing control system of FIG. 1 taken along line 15-15 of FIG. 3.
Figure 16:
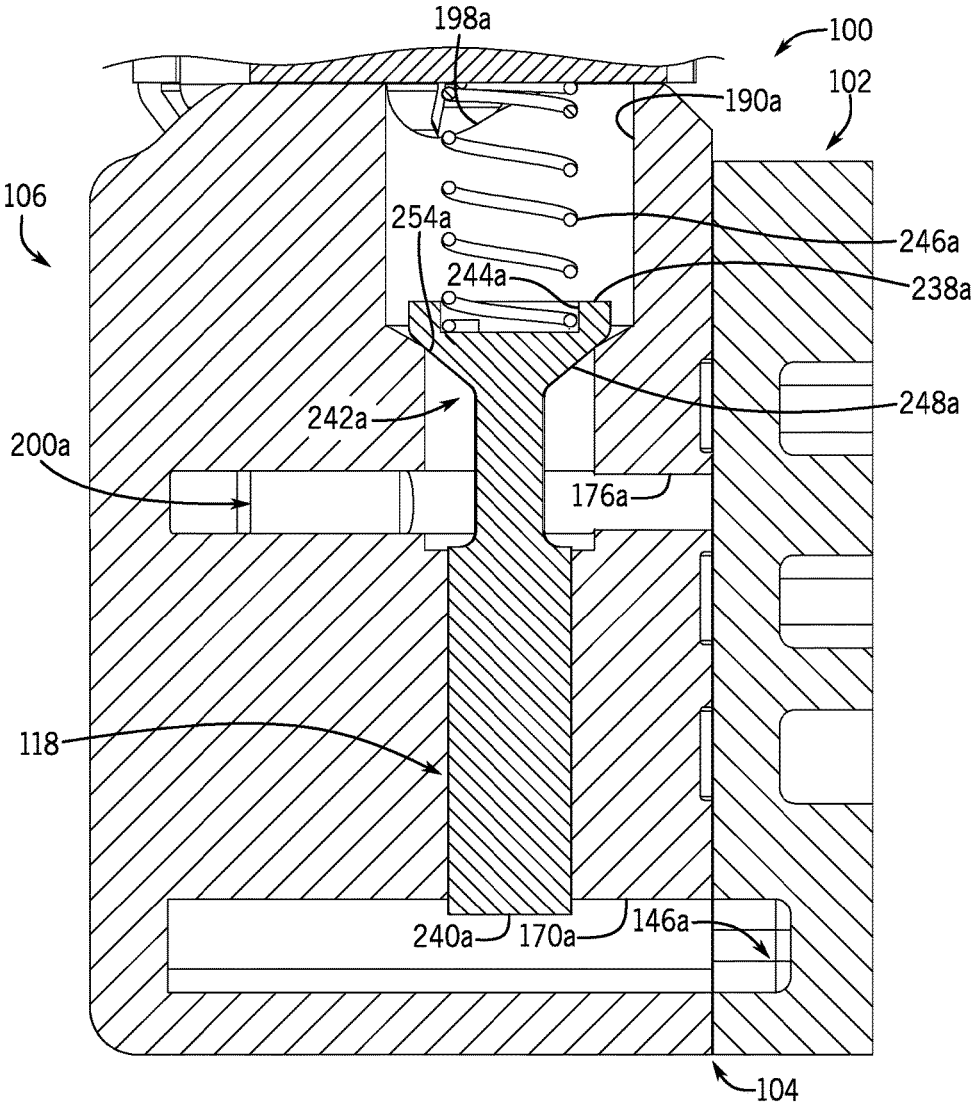
FIG. 16 is a cross-sectional view of the cam phasing control system of FIG. 1 taken along line 16-16 of FIG. 3.

Turning to FIG. 11, the illustrated first regen valve 118 can be in the form of a first poppet 237*a*. The first poppet 237*a* can be dimensioned to be slidably received within the regen valve mounting bore 190*a*. The first poppet 237*a* can include a first end 238*a*, a second end 240*a*, and a tapered portion 242*a* arranged therebetween. The first end 238*a* can include a spring recess 244*a*, which defines an axial recess therein. A biasing element 246*a* can be received within the spring recess 244*a* and can be configured to bias the first poppet 237*a* downward in a direction toward the second end 240*a*. The tapered portion 242*a* includes a tapered surface 248*a* that tapers radially inward as it extends toward the second end 240*a*. The tapered surface 248*a* tapers to a neck portion 250*a* arranged between the first end 238*a* and the second end 240*a*. The neck portion 250*a* defines a reduced diameter compared to the rest of the first poppet 237*a*. It should be appreciated that alternative designs of the first regen valve 118 are possible to achieve similar functionality (i.e., selectively opening in response to a pressure in the supply chamber 170*a*). For example, as shown in FIGS. 12 and 13, the first regen valve 118 may be in the form of a ball 251*a* biased closed by the biasing element 246*a*, or the first regen valve 118 may be in the form of a swing 253*a*. The various forms of the first regen valve 118 illustrated in FIGS. 11, 12 and 13 are but three non-limiting examples, and one of skill in the art would appreciate that further alternative configurations may be possible to achieve the desired functionality.

Assembly of the first side 122 of the cam phasing control system 100 will be described with reference to FIGS. 1-14. It should be appreciated that the assembly of the second side 124 can be similar to the process described below. It should also be appreciated that the order of the process described below is not meant to be limiting in any way and, certainly, other orders of operation are possible and included within the scope of the present disclosure.

Initially, the first control valve 114 can be assembled with the mounting bracket plate 112. The housing 200*a* of the first control valve 114 can be provided with the internal components (e.g., the solenoid 206*a*, armature tube 214*a*, armature 216*a*, pin 222*a*, etc.) arranged within the housing 200*a*. The pole piece 204*a* can be installed through a control valve aperture 252*a* of the mounting bracket plate 112. The housing 200*a*, with the internal components arranged therein, can then be coupled over the mounting bracket plate 112 and onto the pole piece 204*a*. The first regen valve 118, for example, in the form of the first poppet 237*a* of FIG. 11, can then be installed into the regen valve mounting bore 190*a* and held in place by the tapered surface 248*a* engaging a poppet seat 254*a* within the regen valve mounting bore 190*a*. With the first regen valve 118 installed within the regen valve mounting bore 190*a*, the first regen valve 118 can be in fluid communication with the supply chamber 170*a*. If the required, the biasing element 246*a* can then be installed into the regen valve mounting bore 190*a* on top of the first regen valve 118 such that the biasing element 246*a* can be received within the spring recess 244*a*.

The first control valve 114 with the mounting bracket plate 112 coupled thereto can be installed onto the manifold 106 such that the spool 202*a* is received within the control valve mounting bore 188*a* and a regen valve portion 256*a* of the mounting bracket plate 112 covers the regen valve mounting bore 190*a*. A fastening element (not shown) can be threaded through a bracket aperture 258*a* of the mounting bracket plate 112 and into the mounting aperture 192*a* in the manifold 106. Upon the fastening element (not shown) being threaded into the mounting aperture 192*a*, the first control valve 114 can be secured to the manifold 106 and the regen valve portion 256*a* of the mounting bracket plate 112 can compress the biasing element 246*a* thereby biasing the first regen valve 118 into a first regen valve position. In the first regen valve position, fluid communication can be inhibited between the regen chamber 176*a* and the outlet port 198*a*. As described above, the outlet port 198*a* can define a generally U-shaped profile, or another profile as desired. This can enable fluid to flow through the outlet port 198*a* with the regen valve portion 256*a* of the mounting bracket plate 112 secured onto the regen valve mounting bore 190*a*.

With the first control valve 114 and the first regen valve 118 secured within and coupled to the manifold 106, the end plate 102 can be fastened to the front surface 148 of the manifold with the filter plate 104 arranged therebetween to complete the assembly of the cam phasing control system 100. The assembled cam phasing control system 100 can be coupled, for example, to a cylinder head of an internal combustion engine (not shown) such that the first side 122 of the cam phasing control system 100 is in fluid communication with a first cam phase actuator and the second side 124 of the cam phasing control system 100 is in fluid communication with a second cam phase actuator. Thus, the cam phasing control system 100 described herein provides a bolt-on solution that enables the control of the cam phasing for two cam shafts on an internal combustion engine. The cam phasing control system 100 also significantly reduces the amount of components required to implement the control of two cam phase actuators. For example, the manifold 106 can replace the valve bodies that are included with current cam phase control valves, and a single connector 212 can be used to control both the first and second control valves 114 and 116. Additionally, the filter plate 104 can provide the functionality of what would require six separate filters and six separate check valves in a current cam phasing control system with a single component.

Operation of the cam phasing control system 100 will be described with reference to FIGS. 1-18 in the context of the first side 122 controlling a flow of fluid to and from a cam phase actuator 260. It should be appreciated that the second side 124 can be coupled to a second cam phase actuator and the operational capabilities of the second side 124 can be similar to the first side 122, described below.

In operation, the supply port 129*a* can be in fluid communication with a pump 262 of an internal combustion engine (not shown). The pump 262 can draw fluid (e.g., oil) from a reservoir 264 (e.g., a main oil gallery or oil pan of the internal combustion engine) and furnish the fluid under increased pressure to the supply port 129*a*. The first work-port 134*a* can be in fluid communication with a first actuator port 266 of the cam phase actuator 260. The second work-port 140*a* can be in fluid communication with a second actuator port 268 of the cam phase actuator. The outlet port 198*a* can be in fluid communication with the reservoir 264.

The illustrated spool 202*a* can be a 4-way, 3-position spool moveable between a first spool position 270, a second spool position 272, and a third spool position 274. In the first spool position 270, the cam phase actuator 260 can rotate the cam shaft in a first rotational direction relative to the crank shaft, which can either advance or retard the intake and exhaust valve events relative to the crank shaft. In the third spool position 274, the cam phase actuator 260 can rotate the cam shaft relative to the crank shaft in a second rotational direction opposite to the first rotational direction, which can perform the other of advancing or retarding the intake and exhaust valve events when compared to the first spool position 270. In the second spool position 272, the cam phase actuator 260 can maintain the rotational relationship between the cam shaft and the crank shaft.

The first regen valve 118 can control an operating mode of the cam phase actuator 260. That is, that first regen valve 118 can be moveable between a first regen valve position (FIG. 17) and a second regen valve position (FIG. 18). When the first regen valve 118 is in the first regen valve position (FIG. 17), the cam phase actuator 260 can be operable in a regenerative mode. When the first regen valve 118 is in the second regen valve position (FIG. 18), the cam phase actuator 260 can be operable in an oil pressure actuated mode.

Figure 17:
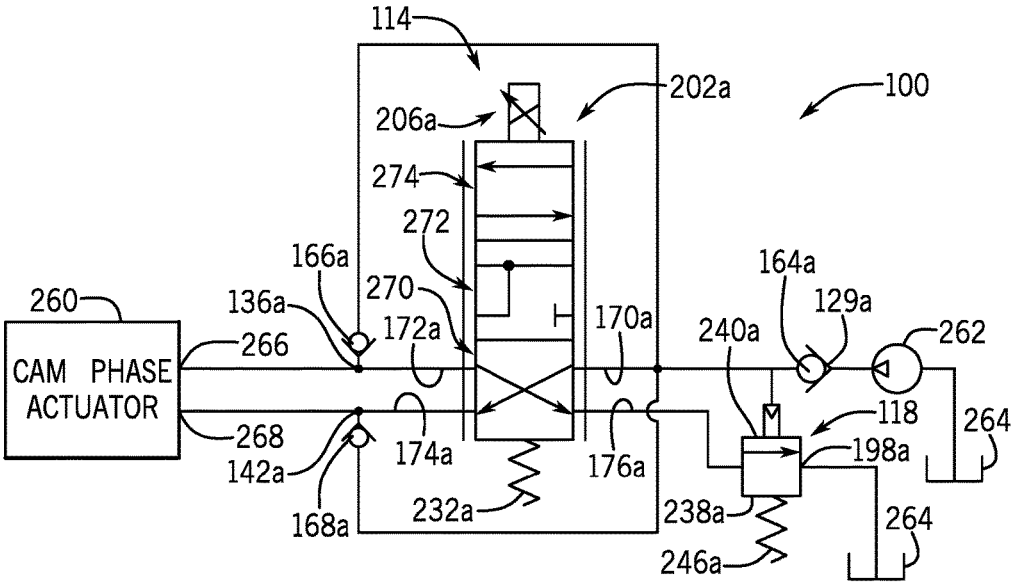
FIG. 17 is a hydraulic schematic illustrating operation of the cam phasing control system of FIG. 1 in a regen mode.
Figure 18:
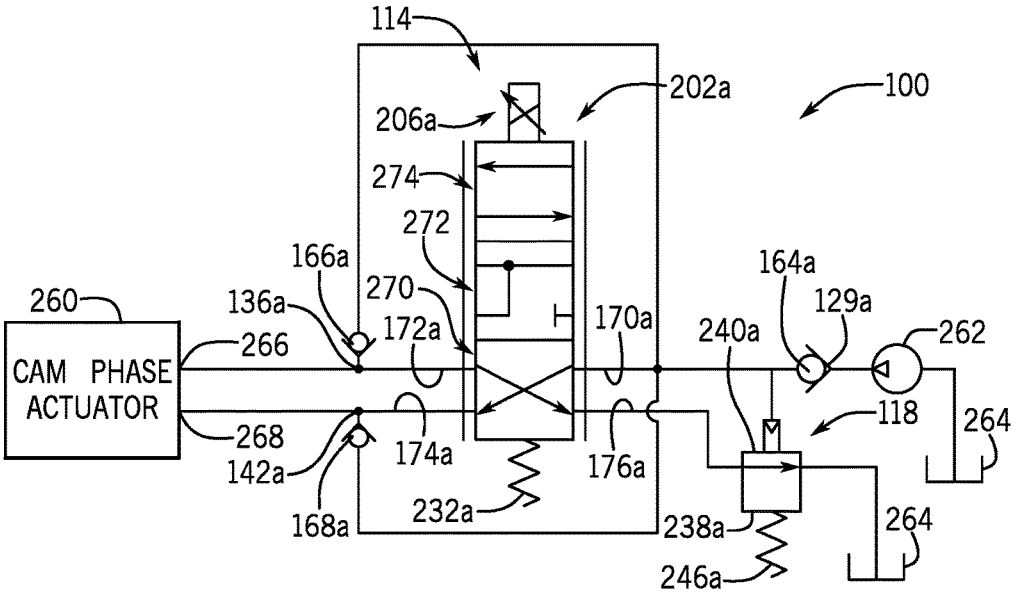
FIG. 18 is a hydraulic schematic illustrating operation of the cam phasing control system of FIG. 1 in an oil pressure actuated mode.

FIGS. 17 and 18 illustrate the spool 202*a* in the first spool position 270. Upon instruction from, for example, an engine controller unit (ECU) to vary the rotational relationship between the cam and the crank shafts (i.e., vary the intake and exhaust valve timing events), the solenoid 206*a* can actuate the spool 202*a* into the first spool position 270. When the spool 202*a* is actuated to the first spool position 270, the first spool cutout 226*a* can provide fluid communication between the supply chamber 170*a* and the second port chamber 174*a* through the internal bore 224*a* of the spool 202*a*. Additionally, the spool notch 228*a* can provide fluid communication between the first port chamber 172*a* and the regen chamber 176*a*.

The pump 262 can supply fluid to the supply port 129*a* and the fluid supplied by the pump 262 can flow through the supply check valve 164*a* and into the pre-supply chamber 178*a*. Fluid communication can be provided from the pre-supply chamber 178*a* into the supply chamber 170*a* via the supply passageway 146*a* in the end plate 102. Fluid flowing from the supply passageway 146*a* into the supply chamber 170*a* can flow through the filter 158*a* in the second supply cutout 152*a* thereby filtering contaminants and/or particulates prior to entry into the supply chamber 170*a*.

The fluid in the supply chamber 170*a*, which is supplied by the pump 262, can apply a force to the first regen valve 118 in a direction towards the outlet port 198*a*. Simultaneously, the fluid in the supply chamber 170*a* can flow through the internal bore 224*a* of the spool 202*a* and into the second port chamber 174*a*. From the second port chamber 174*a*, the fluid can flow to the second workport 140*a* through the filter 162*a* and to the second actuator port 268 of the cam phase actuator 260. Thus, in the first spool position 270, pressurized fluid can flow from the pump 262 to the second actuator port 268. With pressurized fluid entering the second actuator port 268, fluid can flow from the first actuator port 266 towards the first workport 134*a*. Where the fluid flows once it reaches the first workport 134*a* depends on the fluid pressure in the supply chamber 170*a* supplied by the pump 262. That is, if the pump pressure supplied to the supply chamber 170*a* is below a regen pressure threshold (i.e., the pump pressure applies a force to the first regen valve 118 that is unable to overcome the opposing force applied by the biasing element 246*a*), the first regen valve 118 can remain in the first regen valve position (FIG. 17).

With the first regen valve 118 in the first regen valve position (FIG. 17), the fluid flowing from the first actuator port 266 to the first workport 134*a* can be inhibited from flowing through the regen chamber 176*a* to the outlet port 198*a*. The fluid can then be forced to flow into the first regen port 136*a* through the first regen port check valve 166*a* and into the pre-supply chamber 178*a*. Once in the pre-supply chamber 178*a*, the fluid can flow into the second actuator port 268, as described above. Thus, in the first regen valve position, the first regen valve 118 can enable the fluid flowing from the first actuator port 266 to regenerate and flow back into the second actuator port 268. This can enable the pump 262 to only provide make-up flow due to leakage losses. Additionally, the cam phase actuator 260 can operate in a regenerative mode where the cam phase actuator 260 can harvest cam torque pulses applied thereto by the cam shaft to alter the rotational relationship between the cam shaft and the crank shaft.

If the pump pressure supplied to the supply chamber 170*a* is above a regen pressure threshold (i.e., the pump pressure applies a force on the first regen valve 118 in a direction towards the outlet port 198*a* that is sufficient to overcome the opposing force applied by the biasing element 246*a*), the first regen valve 118 can move to in the second regen position (FIG. 18). In the second regen valve position, the first regen valve 118 can be displaced and provide fluid communication between the regen chamber 176*a* and the outlet port 198*a*.

With the first regen valve 118 in the second regen valve position (FIG. 18), the fluid flowing from the first actuator port 266 can flow into the first workport 134*a*, through the filter 160*a*, and into the first port chamber 172*a*. The fluid in the first port chamber 172*a* can then flow past the spool notch 228*a* and into the regen chamber 176*a*. Once in the regen chamber 176*a*, the fluid can flow through the outlet port 198*a* to the reservoir 264. Thus, in the second regen valve position, the cam phase actuator 260 can operate in an oil pressure actuated mode where the pressurized fluid supplied by the pump 262 to the second actuator port 268 can alter the rotational relationship between the cam shaft and the crank shaft. It should be appreciated that the regen pressure threshold can be tunable. That is, a biasing element 246*a* with a desired stiffness (i.e., provides a desired force on the first regen valve 118 in a direction away from the outlet port 198*a*) can be selected to determine the pump pressure that actuates the cam phase actuator 260 between the regenerative mode and the oil pressure actuated mode.

The operation of the first regen valve 118 can be similar when the spool 202*a* is actuated into the second spool position 272 and the third spool position 274. In the second spool position 272, the spool 202*a* can provide fluid communication between the pump 262 and both the first actuator port 266 and the second actuator port 268 to maintain a rotational relationship between the cam shaft and the crank shaft. The operation of the third spool position 274 can be opposite to the first spool position 270, described above, with the pump supplying fluid to the first actuator port 266, and the fluid from the second actuator port 268 either regenerating back to the first actuator port 266 or flowing to the reservoir 264.

It should be appreciated that alternative designs, arrangements, and configurations of the cam phasing control system 100 may be possible to achieve the operational aspects of the system, described above. That is, in some non-limiting examples, the cam phasing control system 100 may not include the end plate 102 and/or the filter plate 104. Instead, the functionality of the check valves and filters on the filter plate 104 may be integrated into the manifold 106 and/or accomplished external from the manifold 106 on a given application.

Figure 19:
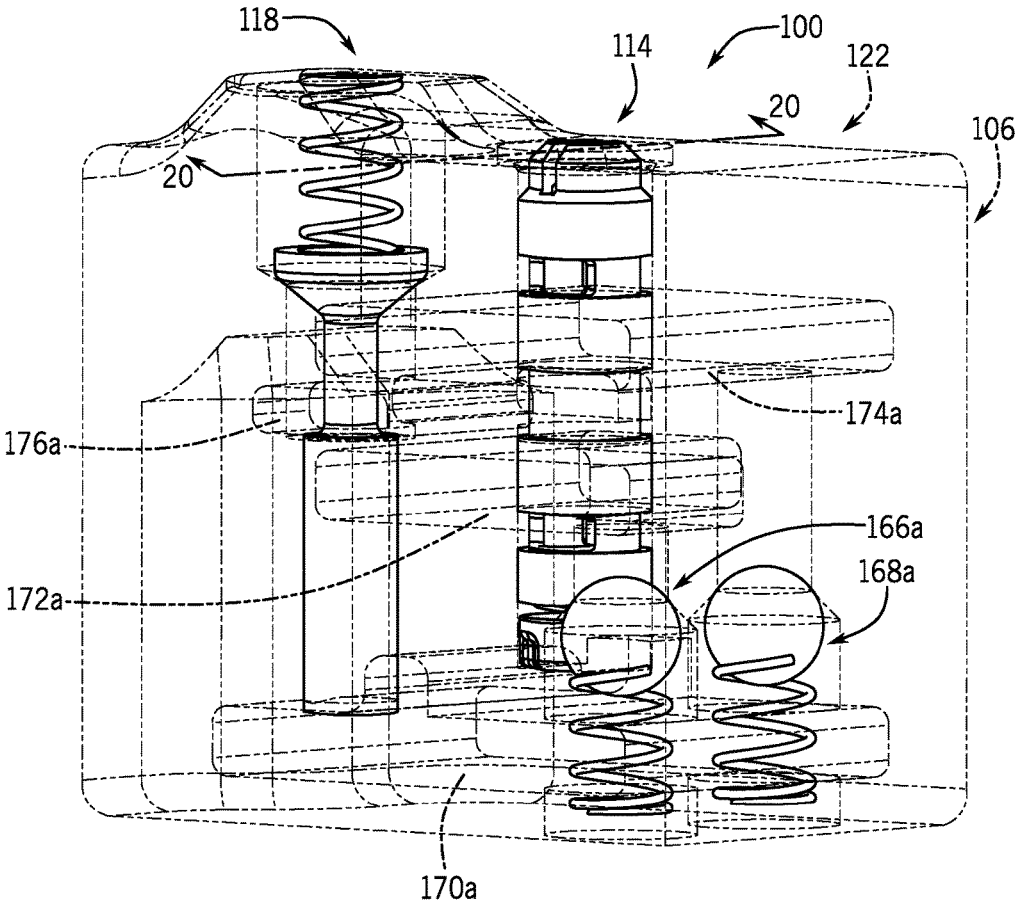
FIG. 19 is a top, front, left isometric view of a first side of a cam phasing control system with a manifold of the cam phasing control system transparent according to another aspect of the present disclosure.
Figure 20:
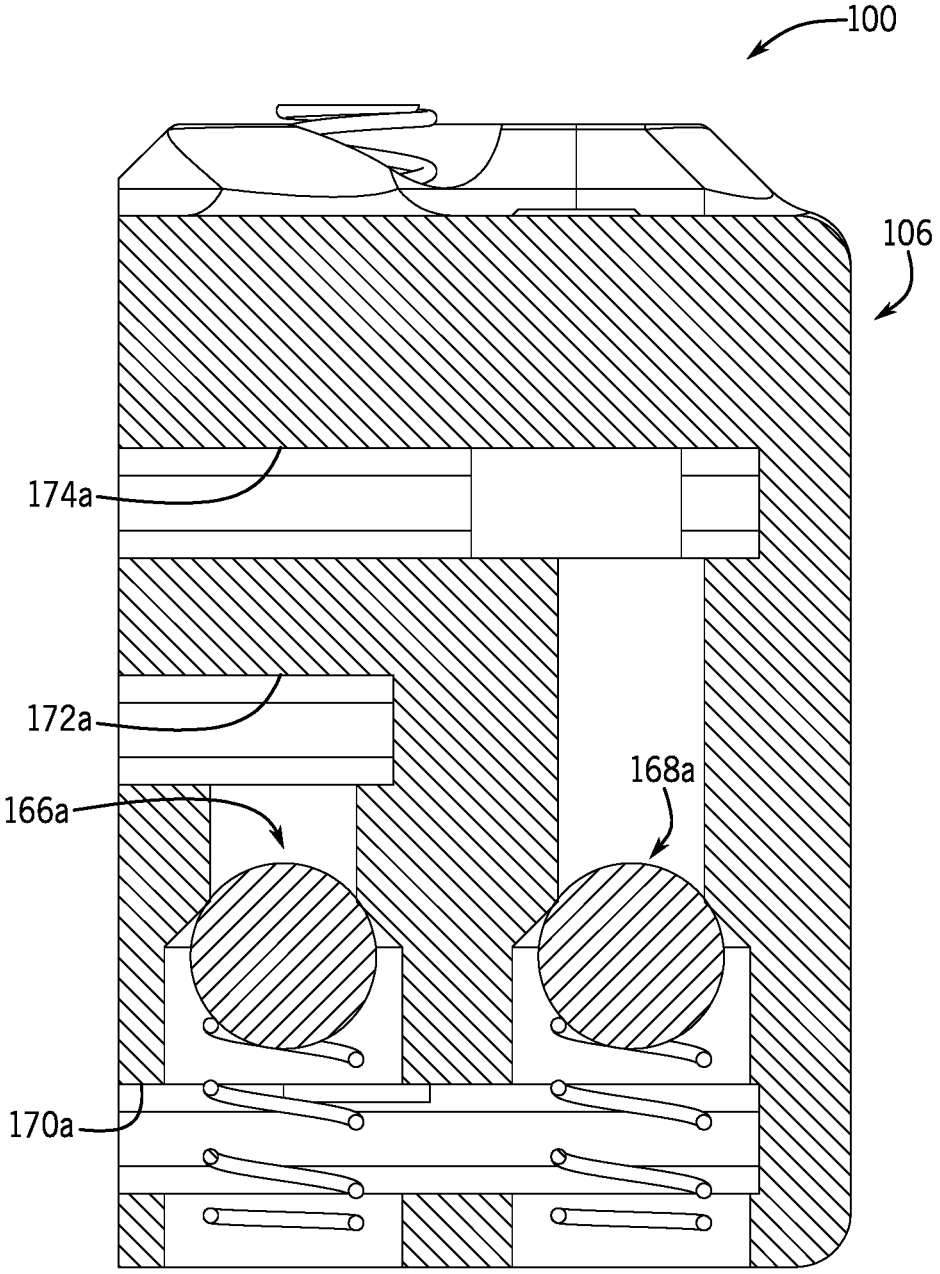
FIG. 20 is a cross-sectional view of the cam phasing control system of FIG. 19 taken along line 20-20.

FIGS. 19 and 20 illustrate the first side 122 an alternative configuration of the cam phasing control system 100 according to another non-limiting example of the present disclosure. As shown in FIGS. 19 and 20, the cam phasing control system 100 may not include the end plate 102 and the filter plate 104, and can include the first regen port check valve 166*a* and second regen port check valve 168*a* integrated into the manifold 106. The supply check valve 164*a* (not shown) may be arranged on a supply line (not shown) in fluid communication with the supply chamber 170*a*. Additionally, the filters 158*a*, 160*a*, and 162*a* (not shown) may be arranged externally from the manifold 106. The cam phasing control system 100 of FIGS. 19 and 20 can achieve similar operation and performance as the cam phasing control system 100 of FIGS. 1-18.

The cam phasing control system 100 described herein can provide a bolt-on solution that enables the control of the cam phasing for two cam shafts on an internal combustion engine. The cam phasing control system 100 can also significantly reduces the amount of components required to implement the control of two cam phase actuators.

Thus, while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

We claim:

1. A cam phasing control system configured to be coupled to an internal combustion engine for controlling a flow of fluid to and from a cam phase actuator, the internal combustion engine including a pump, a cam shaft, and a crank shaft, the cam phase actuator including a first actuator port and a second actuator port, the cam phasing control system comprising:

a manifold including a supply chamber, a first port chamber, a second port chamber, a regen chamber, and an outlet port;

at least one control valve including a solenoid and a spool moveable between a plurality of positions in response to activation of the solenoid, wherein the spool is slidably received within the manifold; and at least one regen valve arranged within the manifold and in fluid communication with the regen chamber, wherein the at least one regen valve is moveable between a first regen valve position where fluid communication is inhibited from the regen chamber through the outlet port and a second regen valve position where fluid communication is provided from the regen chamber through the outlet port, wherein the at least one regen valve is moveable between the first position and the second position in response to a pressure in the supply chamber, wherein when the at least one regen valve is in the first regen valve position, the cam phase actuator is operable in a regenerative mode, and when the at least one regen valve is in the second poppet position, the cam phase actuator is operable in an oil pressure actuated mode.

2. The cam phasing control system of claim 1, wherein each of the supply chamber, the first port chamber, and the second port chamber are formed within the manifold.

3. The cam phasing control system of claim 1, wherein when the at least one regen valve is in the first regen valve position, fluid communication is provided between one of the first port chamber and the second port chamber and the supply chamber.

4. The cam phasing control system of claim 1, wherein when the at least one regen valve is in the second regen valve position, fluid communication is provided between one of the first port chamber and the second port chamber and the outlet port.

5. The cam phasing control system of claim 1, further comprising a supply check valve to enable fluid to flow only in a direction from the pump to the supply chamber.

6. The cam phasing control system of claim 1, further comprising a first regen check valve to enable fluid to flow only in a direction from the first port chamber to the supply chamber.

7. The cam phasing control system of claim 6, wherein the first regen check valve is integrated into the manifold.

8. The cam phasing control system of claim 1, further comprising a second regen check valve to enable fluid to flow only in a direction from the second port chamber to the supply chamber.

9. The cam phasing control system of claim 8, wherein the second regen check valve is integrated into the manifold.

10. The cam phasing control system of claim 1, further comprising an end plate including a supply port, a first workport, a first regen port, a second workport, and a second regen port, wherein the first workport is in fluid communication with the first actuator port and the first port chamber, the second workport is in fluid communication with the second actuator port and the second port chamber, and the supply port is in fluid communication with the pump and the supply chamber.

11. The cam phasing control system of claim 10, wherein the manifold includes a pre-supply chamber in fluid communication with the supply chamber via a supply passageway formed in the end plate.

12. The cam phasing control system of claim 10, wherein the first workport is in fluid communication with the first regen port and the second workport is in fluid communication with the second regen port.

13. The cam phasing control system of claim 1, further comprising a filter plate including a plurality of check valves and a plurality of filters formed thereon.

14. The cam phasing control system of claim 13, wherein the filter plate includes a first regen port check valve, a second regen port check valve, and a supply check valve.

15. The cam phasing control system of claim 14, wherein the first regen port check valve enables fluid to flow only in a direction from the first port chamber to the supply chamber.

16. The cam phasing control system of claim 14, wherein the second regen port check valve enables fluid to flow only in a direction from the second port chamber to the supply chamber.

17. The cam phasing control system of claim 14, wherein the supply check valve enables fluid to flow only in a direction from the pump to the supply chamber.

18. The cam phasing system of claim 14, wherein each of the first regen port check valve, the second regen port check valve, and the supply check valve are reed valves.

19. The cam phasing control system of claim 13, wherein the filter plate includes a first filter, a second filter, and a third filter.

20. The cam phasing control system of claim 19, wherein the first filter is arranged to filter fluid flowing into the supply chamber.

21. The cam phasing control system of claim 19, wherein the second filter is arranged to filter fluid flowing into and out of the first port chamber.

22. The cam phasing control system of claim 19, wherein the third filter is arranged to filter fluid flowing into and out of the second port chamber.

23. The cam phasing control system of claim 1, wherein the manifold is symmetric about a center plane.

24. The cam phasing control system of claim 23, wherein the manifold includes another supply chamber, another first port chamber, another second port chamber, another regen chamber, and another outlet port.

25. The cam phasing control system of claim 24, wherein the at least one regen valve comprises a first regen valve and a second regen valve and the at least one control valve comprises a first control valve and a second control valve.

26. The cam phasing control system of claim 25, wherein the first control valve and the second control valve are coupled to the manifold by a mounting bracket plate.

* * * * *